340-566 SR
12/8/87 XR 4,712,098

United States Patent [19]

Laing

[11] Patent Number: 4,712,098

[45] Date of Patent: Dec. 8, 1987

[54] INERTIA SENSITIVE DEVICE

[75] Inventor: John Laing, Gillingham, England

[73] Assignee: Tapeimp Limited, North Yorkshire, England

[21] Appl. No.: 890,493

[22] Filed: Jul. 25, 1986

[30] Foreign Application Priority Data

Jul. 27, 1985 [GB] United Kingdom ..... 8519026

[51] Int. Cl.[4] ..... G08B 21/00

[52] U.S. Cl. ..... 340/669; 310/319; 310/354; 310/369; 340/65; 340/566

[58] Field of Search ..... 340/669, 566, 65; 310/312, 319, 353, 354, 356, 369, 324, 351, 25; 73/652, 654

[56] References Cited

U.S. PATENT DOCUMENTS

| | | | |
|---|---|---|---|
| 3,455,148 | 7/1969 | Foster et al. | 340/669 |
| 3,701,903 | 10/1972 | Merhar | 310/319 |
| 3,863,250 | 1/1975 | McCluskey, Jr. | 310/319 |

*Primary Examiner*—Glen R. Swann, III

*Attorney, Agent, or Firm*—Rodman & Rodman

[57] ABSTRACT

An improved inertia sensitive device, which is directionally sensitive to activating impulses, comprises a piezoelectric plate (7), a housing (3,4) gripping the plate along at least a major part of its periphery, a weight (9) supported at or adjacent to the center of the plate, and means (FIG. 2) to detect signals generated by the plate (7).

8 Claims, 2 Drawing Figures

INERTIA SENSITIVE DEVICE

BACKGROUND OF THE INVENTION

1. Field of the Invention

The present invention is an inertia sensitive device, such as may be used for detecting motion as part of an alarm system or for reacting to impact.

It is known to use piezoelectric sensors to detect unwanted motion, for example vibrations caused by the presence of an intruder or by unauthorised removal of equipment associated with the sensor. Highly sensitive sensors of this type have been developed, to the extent that very small vibrations caused by an intruder at some distance from the device may readily be detected. However a major disadvantage of such devices is that, because of their sensitivity, they also react to vibrations which are a consequence of acceptable events or conditions. Such reactions are at best a nuisance and may at worst devalue the significance of an important alarm signal, with possibly serious consequences.

OBJECTS AND SUMMARY OF THE INVENTION

It is desirable that an improved device of this general type be made available, which is better able to distinguish between different forms of potentially activating motion, while retaining the sensitivity afforded by such devices. It is an object of the present invention to provide such an improved device.

The inertia sensitive device according to the present invention comprises a piezoelectric plate, a housing gripping the plate along at least a major part of its periphery, a weight supported by the plate at or adjacent to the centre of said plate, and means for detecting electrical signals generated by said plate.

The piezoelectric plate incorporates a material, a piezoelectric crystal, which becomes polarised under pressure, including such pressures as arise on flexing of the plate. Thus any distortion of the plate may be used to generate an electrical signal as an indication, and measure, of the distortion occurring. In the present invention, the piezoelectric material is preferably supported upon a thin metal plate, which provides reinforcement for the piezoelectric material and also affords a point of electrical contact with that material. In a preferred form, the piezoelectric plate used in the invention comprises a piezoelectric ceramic plate, a metal plate bonded to the ceramic plate, and a layer of electrically conducting material, for example silver, upon that side of the ceramic plate which is remote from the metal plate.

The plate may be of any desired peripheral shape, including rectangular, but is preferably symmetrically polygonal and in particular is preferably circular, that is a disc.

The plate is retained by a housing which not only supports the plate around its periphery but positively grips the plate along at least a major part of its periphery. Advantageously the housing is in the form of two parts such that, when the housing is assembled, the plate is gripped at its periphery between the two parts of the housing. The housing may be an open structure in which the plate is exposed but is preferably closed so that the plate is enclosed therein and thereby protected from damage. In one preferred form of the invention, the housing, when assembled, is in the form of a squat cylinder conforming approximately to the shape of a piezoelectric disc therein.

Supported by the piezoelectric plate at or adjacent to the centre of the plate is a weight. The size of the weight is a matter of choice and/or experiment depending upon design considerations which will appear more clearly hereinafter. In particular the function of the weight is to add mass to the centre of the piezoelectric plate and thereby to increase the reaction of the plate to a given stimulus. The size of the weight should reflect this. The weight may be secured to one face of the piezoelectric plate or may be in two parts on the opposite faces of the plate or even, if desired, extending through the thickness of the plate.

The detector means will be an electric circuit designed to receive an electric signal generated by the plate and to respond in any desired way to a signal exceeding a predetermined value. The response invoked by such a signal may be to sound an audible alarm, activate a visual alarm, produce a printed record or initiate some further warning or corrective action.

The device according to the invention is designed to react differently to physical impulses received from different directions and thereby to ensure that impulses received from one direction produce a signal above a threshold value and that impulses from another direction produce a signal, if any, below that value. Thus physical impulses received radially at the edge of the plate produce a smaller signal than impulses received parallel to the axis of the plate, that is perpendicular to the plane of the plate.

By way of example, a device according to the present invention may be used in a vehicle to activate emergency action in the event of a collision. In this way, the fuel supply may be switched off and/or protective air bags inflated, in either case immediately on impact. It would be impossible to use a known motion sensor for this purpose as such a sensor would respond to normal vibrations in the vehicle of the type generated by the road surface in normal use. Because the device of the present invention is directional, it is able to "ignore" non-directional vibratory impulses but to respond immediately to any impulse caused by impact of the vehicle with another vehicle or other structure.

BRIEF DESCRIPTION OF THE DRAWINGS

The invention will now be further described with reference to the accompanying drawings, wherein.

DESCRIPTION OF THE PREFERRED EMBODIMENT

Figure 1:
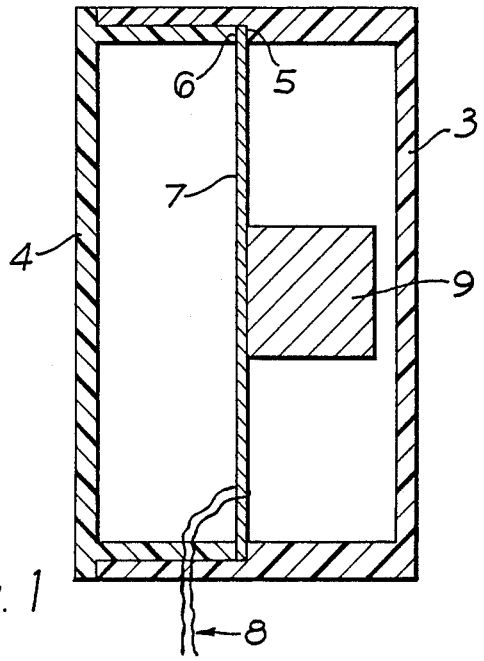
FIG. 1 is a view in cross-section of the sensor which is a feature of one embodiment of inertia sensitive device according to the present invention.

The sensor illustrated in FIG. 1 includes a housing formed in two cylindrical halves 3, 4 each moulded in synthetic plastics material. Gripped firmly between seatings 5, 6 formed in the housing halves is a piezoelectric disc 7. The disc 7 is a sandwich assembly comprising a piezoelectric plate bonded at one face to a metal plate and coated on its other face with a layer of silver. Electric leads 8 connected to the metal plate and silver coating respectively convey electric signals generated by any distortion of the plate to the circuit shown in FIG. 2.

If the sensor is mounted with the disc 7 in a vertical plane as shown in FIG. 1, then nondirectional vibrations or vertical vibrations have little effect on the disc 7 and give rise to only a small piezoelectric signal or none at all. However impulses in a generally horizontal direction tend to distort the disc out of the vertical plane and produce significant signals from the disc 7, enhanced by the mass of a weight 9 mounted centrally on one face of the disc.

Figure 2:
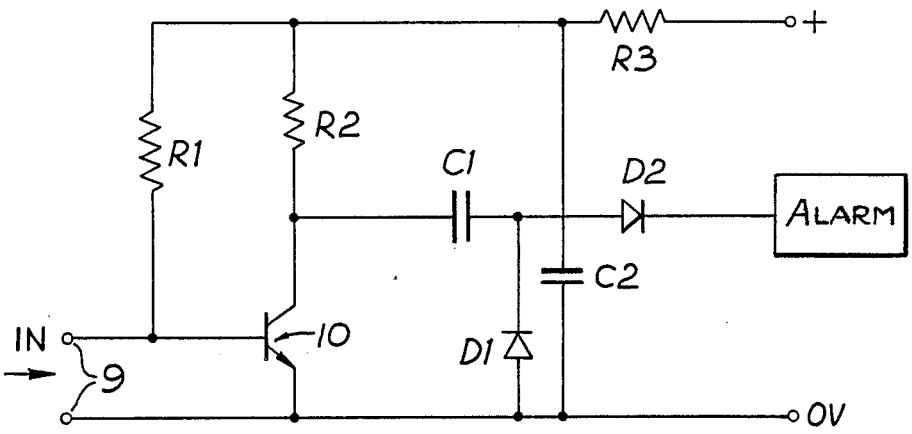
FIG. 2 illustrates an electrical circuit for use with the sensor of FIG. 1.

The electric leads 8 are connected to the input terminals 9 of the circuit of FIG. 2, which functions as a low power amplifier. The amplifier takes the form of an n.p.n. (neg/pos/neg) transistor 10 which is biased via a bias resistor R1 (of 46,800 ohms) to give a collector voltage which is about half the supply voltage. The transistor 10 operates in a common emitter configuration and the terminals 9 are connected to the base of the transistor and to zero volts.

When exciting of the disc 7 produces a voltage signal at the terminals 9, the bias voltage at the transistor 10 is caused to decrease and increase. As indicated, the transistor acts as an amplifier, whose gain is determined by a load resistor R2 (of 56,000 ohms). The amplified signal is now passed to a d.c. blocking capacitor C1 (of 0.1 $\mu$F) and to a full wave rectifier in the form of the diodes D1 and D2. The resulting signal is a d.c. pulse, which can be used as described above to trigger an alarm or initiate corrective action. Preferably such an alarm or the like is set to respond only to signals exceeding a predetermined threshold value, so that small pulses generated in response to acceptable vibrations do not trigger an alarm but that larger signals generated by impact or other physical impulses perpendicular to the plane of the disc do trigger the alarm or activate a corrective action.

For completeness, it should be mentioned that, in the circuit shown in FIG. 2, the capacitor C2 has a rating of 10 $\mu$F and the resistor R3 is of 10,000 ohms.

The inertia sensitive device according to the present invention, exemplified by the illustrated embodiment, has many applications both in protective alarm systems and for safety devices. Its directional sensitivity and its compact design make it particularly attractive for use in a wide range of situations.

What is claimed is:

1. An inertia sensitive device comprising a piezoelectric plate, a housing gripping the plate along at least a major part of the periphery of said plate, a weight supported by the plate at a position in the region of the centre of said plate, and means for detecting electrical signals generated by said plate.

2. An inertia sensitive device according to claim 1, wherein said piezoelectric plate comprises a plate of piezoelectric ceramic material bonded on a first face thereof to a metal plate and having on its second face a coating of electrically conducting material.

3. An inertia sensitive device according to claim 2, wherein said piezoelectric plate is of a symmetrical polygonal shape.

4. An inertia sensitive device for detecting physical impulses thereon, which device comprises:

(a) a sensor plate comprising, in successive layers, a metal plate, a layer of piezoelectric ceramic material and a coating of electrically conductive material;

(b) said sensor plate being in shape a rotationally symmetrical polygon or a circle;

(c) a housing comprising first and second housing parts;

(d) said first and second housing parts together gripping therebetween at least a major part of the periphery of said sensor plate and together surrounding and enclosing said sensor plate;

(e) a weight mounted upon said sensor plate on one face thereof at the centre of said face; and (f) detector means for detecting piezoelectric signals generated in the ceramic material of said sensor plate, whereby physical impulses upon said device giving rise to flexion of said plate are detected by said detector means.

5. An inertia sensitive device according to claim 4, wherein said sensor plate is a circular disc and said housing is a squat cylinder conforming approximately to the shape of the disc.

6. An inertia sensitive device for selectively detecting physical impulses thereon from different directions, which device comprises:

(a) a circular sensor plate comprising a disc of piezoelectric ceramic material having bonded to one face thereof a circular metal plate and having on the opposite face thereof a coating of electrically conductive metallic material;

(b) first and second housing parts, both of which are squat generally cylindrical parts of diameter exceeding that of the sensor plate by a small amount and which between them positively grip said sensor plate along its periphery and together enclose said sensor plate;

(c) a weight mounted upon one face of said sensor plate at the radial centre thereof;

(d) electrical connection means to said metal plate and to said conductive coating respectively; and (e) an electrical circuit including said electrical connection means to amplify piezoelectric signals arising in said piezoelectric ceramic material and to respond to the amplified signals.

7. An inertia sensitive device according to claim 6, wherein said electrical circuit is designed to respond ony to signals exceeding a preset value.

8. An inertia sensitive device according to claim 7, wherein said electrical circuit includes alarm means to respond to said signals.

* * * * *